United States Patent [19]

Iwata et al.

[11] Patent Number: 4,817,761

[45] Date of Patent: Apr. 4, 1989

[54] CONTROL APPARATUS FOR ELEVATOR

[75] Inventors: Shigemi Iwata; Hiroyuki Ikejima, both of Inazawa, Japan

[73] Assignee: Mitsubishi Denki Kabushiki Kaisha, Japan

[21] Appl. No.: 187,517

[22] Filed: Apr. 28, 1988

[30] Foreign Application Priority Data

Apr. 28, 1987 [JP] Japan ..... 62-105018
Dec. 25, 1987 [JP] Japan ..... 62-329208

[51] Int. Cl.[4] ..... B66B 1/30
[52] U.S. Cl. ..... 187/116
[58] Field of Search ..... 187/112, 116, 118

[56] References Cited

U.S. PATENT DOCUMENTS

| | | | |
|---|---|---|---|
| 4,046,229 | 9/1977 | Kernick et al. | 187/116 |
| 4,117,382 | 9/1978 | Yonemoto | 187/118 X |
| 4,124,101 | 11/1978 | Satoh | 187/116 |
| 4,161,235 | 7/1979 | Caputo et al. | 187/116 |
| 4,434,874 | 3/1984 | Caputo | 187/116 |
| 4,691,807 | 9/1987 | Iwata | 187/117 |
| 4,742,892 | 5/1988 | Iwata | 187/119 |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A control apparatus for an elevator according to this invention comprises a signal setter for setting a new value instead of a value of great variation when at least one signal at the present time among a transmission reference speed command signal transmitted to a speed controller through a transmission interface, a cage speed signal, and a controlled variable based on these signals greatly varies as compared with the time-serial value of the corresponding signal detected in the past.

In this invention, the signal setter stores a value at the present time and also stores serially past values with respect to time as to the transmitted reference speed command signal, the cage speed signal, or the controlled variable based on these signals, and it sets the new value not greatly varying, as a present value if the value at the present time greatly varies in view of the past serial values of the corresponding signal. Accordingly, even if any of the transmission interface, cage speed signal-detector, etc. should fail or operate erroneously, the safety of passengers can be secured, and the elevator equipment can be prevented from being damaged.

10 Claims, 8 Drawing Sheets

CONTROL APPARATUS FOR ELEVATOR

BACKGROUND OF THE INVENTION

This invention relates to a control apparatus for an elevator. More particularly, it relates to a control apparatus for an elevator in which the cage of the elevator is safely operated even when a drastic change has arisen in a reference speed command signal, a cage speed signal or a controlled variable based on these signals.

In recent years, with the advancements of microelectronics technology and power electronics technology, there have appeared elevator control apparatuses constructed of microcomputers and semiconductor devices, such as thyristors, which make the most use of these technologies. For example, the official gazette of Japanese Patent Application Laid-open No. 223771/1985 discloses an elevator control apparatus employing two microcomputers.

FIG. 8 shows the schematic construction of the whole elevator equipped with the prior-art elevator control apparatus. Referring to the figure, numeral 1 designates a cage, numeral 2 a counterweight, and numeral 3 a rope which is wound round a sheave 4 and which has the cage 1 coupled to one end thereof and the counterweight 2 coupled to the other end thereof. Numeral 5 indicates an induction motor which drives the sheave 4, numeral 6 a pulse generator which generates pulses proportional to the movement distance of the cage 1 on the basis of the rotation of the motor 5, numeral 7 a counter circuit which counts the pulses from the pulse generator 6, numeral 8 a microcomputer system which receives a cage speed signal 7*a* delivered from the counter circuit 7 and controls the speed of the cage, numeral 9 a three-phase A.C. power source, and numeral 10 a power converter by which three-phase alternating currents are converted into electric power suitable for the speed control of the cage and to which a command signal 8*a* from the microcomputer system 8 is applied, threby to control the torque and r.p.m. of the motor 5.

FIG. 9 shows the details of the microcomputer system 8 mentioned above. This system consists of first and second microcomputers 80 and 90. The first microcomputer 80 is constructed of a CPU 81, and a ROM 83, a RAM 84, an input port 85 and an output port 86 which are connected to the CPU 81 through a bus 82. The input port 85 is supplied with the cage speed signal 7*a* ($V_T$) from the counter circuit 7. This microcomputer 80 has the functions of supervising the service of the cage 1, controlling a door, processing cage calls and hall calls, and generating a reference speed command signal $V_N$.

The second microcomputer 90 is constructed of a CPU 91 which is connected to the CPU 81 of the first microcomputer 80 through a transmission interface 100, and a ROM 93, an input port 95 and an output port 96 which are connected to the CPU 91 through a bus 92. The input port 95 is supplied with the cage speed signal 7*a* ($V_T$) from the counter circuit 7. The second microcomputer 90 has the function of controlling the speed of the cage, and it receives the reference speed command signal $V_N$ generated by the first microcomputer 80, as a transmitted reference speed command signal $V_P$ through the transmission interface 100. Then, it determines the deviation between the transmitted signal $V_P$ and the cage speed signal 7*a* ($V_T$) and executes a phase compensation and a gain compensation so as to finally deliver a torque command $T_M$ to the power converter 10. Thus, the motor 5 is controlled, and the cage 1 is smoothly subjected to a series of operations consisting of start, acceleration, constant-speed run, deceleration and floor arrival.

By way of example, Product 8085A manufactured by Intel Inc. is utilized as the CPU, and Product 8212 similarly manufactured by Intel Inc. is utilized as the transmission interface.

In the prior-art elevator control apparatus as described above, no measure is taken against the malfunction of the transmission interface 100, and hence, problems to be stated below are involved. When an LSI constructing the transmission interface 100 causes the malfunction, any bit lacks or a specified bit becomes "1" in the transmitted reference speed command signal $V_P$ which has been transmitted from the first microcomputer 80 to the second microcomputer 90 through the transmission interface 100, and the transmitted signal $V_P$ becomes different from the original reference speed command signal $V_N$.

This situation will be explained with reference to FIG. 10. When the transmission interface 100 is functioning normally, $V_N=V_P$ holds. However, when any fault occurs in the transmission interface 100 at a time $t_1$ and the specified bit of the signal $V_P$ lacks, $V_P<V_N$ holds as seen from FIG. 10. Then, the cage might be rapidly decelerated to endanger passengers. Besides, when the degree of deceleration is high, the rope wound round the sheave can slip to damage the equipment.

Moreover, if "1" is erected for the specified bit of the transmission interface 100, the cage is rapidly accelerated contrariwise to the above. In addition, similar problems might occur when the transmission interface 100 operates erroneously due to noise or a power source surge.

SUMMARY OF THE INVENTION

This invention has been made in order to solve the problems as mentioned above, and has for its object to provide a safe and reliable control apparatus for an elevator by which, even when a transmission speed pattern or a cage speed signal has suddenly changed due to a fault or noise, passengers are not endangered or elevator equipment is not damaged.

The control apparatus for an elevator according to this invention comprises signal setting means for setting a new value instead of a value of great variation when at least one signal at the present time among a transmission reference speed command signal transmitted to a speed controller through a transmission interface, a cage speed signal, and a controlled variable based on these signals greatly varies as compared with the time-serail value of the corresponding signal detected in the past.

In this invention, the signal setting means stores a value at the present time and also stores serially past values with respect to time as to the transmitted reference speed command signal, the cage speed signal, or the controlled variable based on these signals, and it sets the new value not greatly varying, as a present value if the value at the present time greatly varies in view of the past serial values of the corresponding signal. Accordingly, even if any of the transmission interface, cage speed signal-detection means, etc. should fail or operate erroneously, the safety of passengers can be secured, and the elevator equipment can be prevented from being damaged.

BRIEF DESCRIPTION OF THE DRAWINGS:

Throughout the drawings, the same symbols indicate identical or equivalent portions.

DESCRIPTION OF THE PREFERRED EMBODIMENTS

Now, embodiments of this invention will be described.

Figure 1:
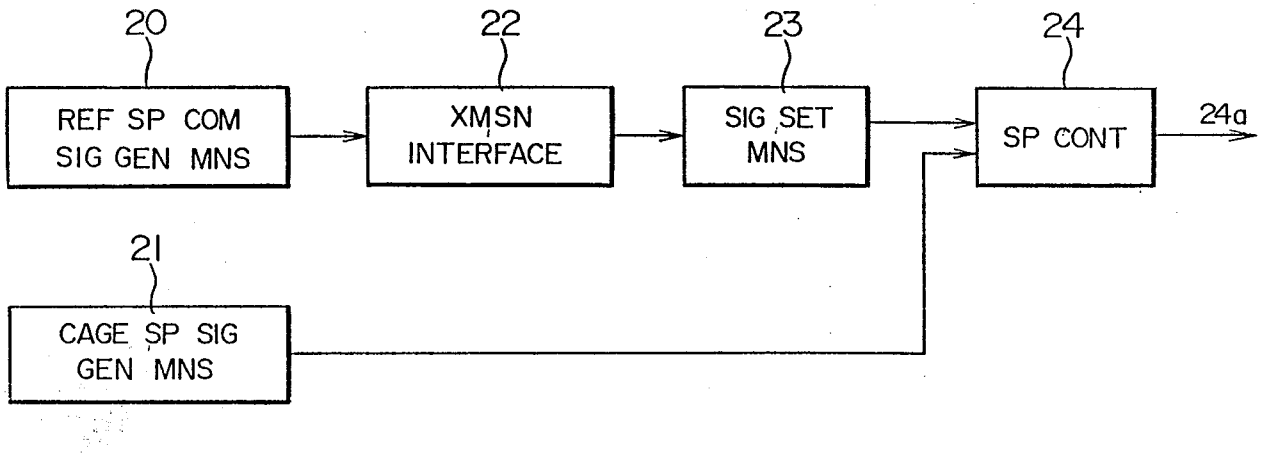
FIG. 1 is a principle arrangement diagram showing an example of an elevator control apparatus according to this invention.

FIG. 1 shows a principle arrangement diagram of an elevator control apparatus according to this invention. Numeral 20 designates reference speed command signal-generation means to generate a normal reference speed command signal $V_N$, numeral 21 designates cage speed signal-detection means to detect the speed of a cage, and numeral 22 designates a transmission interface which transmits the reference speed command signal $V_N$ to signal setting means 23. The signal setting means 23 stores, not only a value at the present time, but also past serial values with respect to time, as to a transmitted reference speed command signal $V_{P1}$ obtained through the transmission interface 22, and its sets a new value not greatly varying, as a present value $V_P$ when the value at the present time suddenly changes to greatly vary in view of the past time-serial values. In addition, numeral 24 indicates a speed controller, which controls the speed of the cage on the basis of the deviation between the reference speed signal $V_P$ obtained through the signal setting means 23 and a cage speed signal $V_T$ delivered as an output from the cage speed signal-detection means 21. An output signal 24*a* from the speed controller 24 is applied as a torque command to the power converter 10 shown in FIG. 8.

Figure 2:
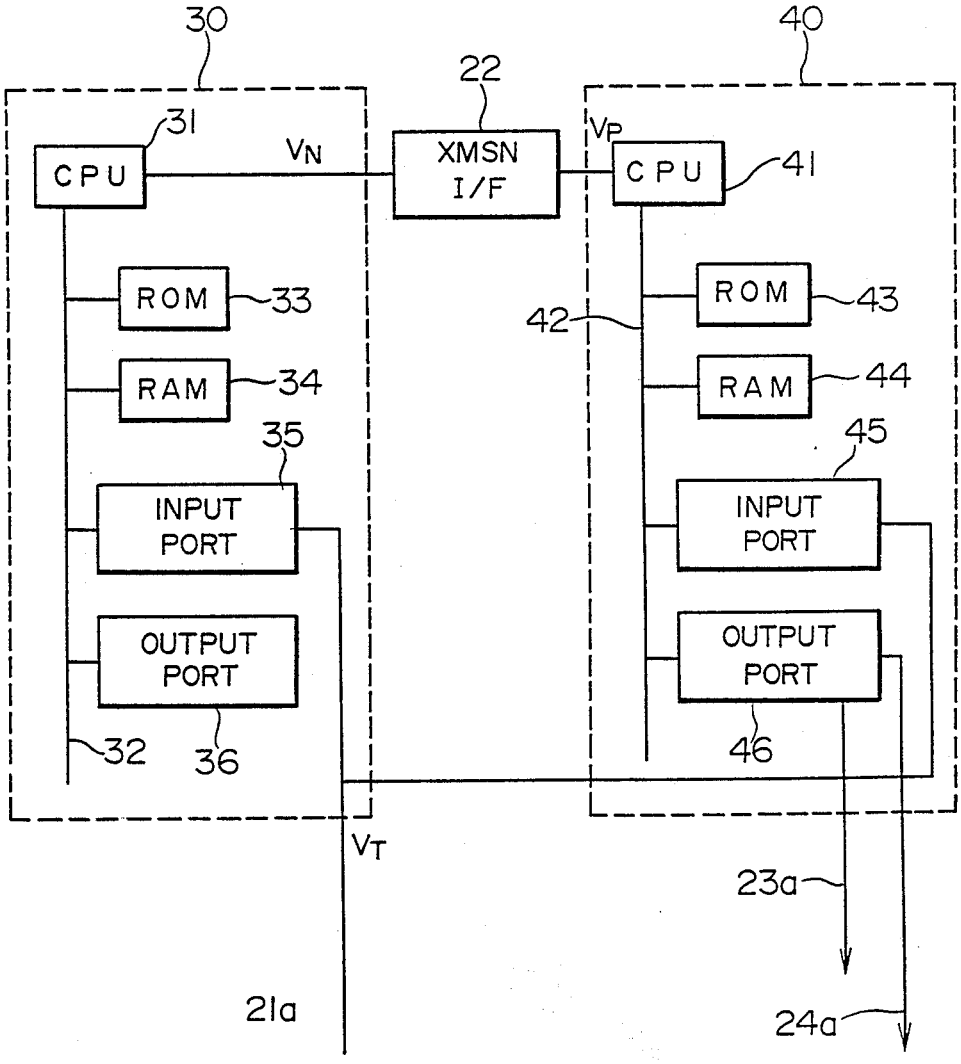
FIG. 2 is a block diagram showing a case where constituents in FIG. 1 are configured of microcomputers.

FIG. 2 shows a circuit block diagram in the case where the arrangement illustrated in FIG. 1 is configured of microcomputers. Referring to FIG. 2, a first microcomputer 30 represents the reference speed command signal-generation means 20 shown in FIG. 1, and it has the functions of supervising the service of the cage, controlling a door, and processing cage calls and hall calls. It is constructed of a CPU 31, and a ROM 33, a RAM 34, an input port 35 and an output port 36 which are connected to the CPU 31 through a bus 32. The input port 35 is supplied with the cage speed signal 21*a* ($V_T$) from the cage speed signal-detection means 21.

In FIG. 2, a second microcomputer 40 represents the signal setting means 23 and the speed controller 24 shown in FIG. 1. It is constructed of a CPU 41 which is connected to the CPU 31 of the first microcomputer 30 through the transmission interface 22, and a ROM 43, a RAM 44, an input port 45 and an output port 46 which are connected to the CPU 41 through a bus 42. The input port 45 is supplied with the cage speed signal $V_T$, while the output port 46 delivers the torque command 23*a* to the power converter 10.

Thus, the second microcomputer 40 receives the reference speed command signal $V_N$ generated by the first microcomputer 30, as the transmitted reference speed command signal $V_{P1}$ through the transmission interface 22. Then, it checks whether or not the value of the transmitted signal $V_{P1}$ greatly varies from the past time-serial values thereof. Besides, it sets the received signal $V_{P1}$ as the reference speed signal $V_P$ when the signal $V_{P1}$ does not greatly vary, and a new value as the signal $V_P$ when the signal $V_{P1}$ greatly varies. Subsequently, it determines the deviation between the signal $V_P$ and the cage speed signal $V_T$ and executes a phase compensation and a gain compensation so as to finally deliver the torque command $T_M$ to the power converter 10. Consequently, the motor 5 is controlled, and the cage 1 is subjected to a series of operations consisting of start, acceleration, constant-speed run, deceleration and floor arrival in accordance with the normal reference speed command signal.

Next, the operation of the signal setting in this embodiment arranged as described above will be explained in conjunction with a flow chart shown in FIG. 3. The program illustrated in this flow chart is stored in the ROM 43 of the second microcomputer 40.

First, at a step 51, a pointer I expressive of a time is incremented by one. At the next step 52, the absolute value of the difference between the present value of the transmitted reference speed command signal $V_{P1}$ and the past value thereof preceding one unit of time and stored in arrayed variables ARVP, namely, ARVP(I−1) is taken, and it is compared with a predetermined value ΔV. Here, if the absolute value is equal to or greater than ΔV, it is decided that the signal $V_{P1}$ transmitted at the present time varies greatly from the past time-serial signal ARVP(I−1), and the operating flow proceeds to a step 53, at which the new value not greatly varying, here, the average of the values of the signal $V_{P1}$ back to the value preceding n units of time, is set as the reference speed command signal $V_P$ and is simultaneously stored as the arrayed variable ARVP(I). On the other hand, if the aforementioned absolute value is found to be less than ΔV, it is decided that the present signal $V_{P1}$ is normal, and the operating flow proceeds to a step 54, at which the signal $V_{P1}$ is set as the reference signal $V_P$ and is stored as the arrayed variable ARVP(I).

The value ΔV is selected at a value which does not endanger passengers and does not damage the elevator equipment, either, even in the presence of some sudden change in the signal $V_P$. Accordingly, the value ΔV may be selected to ΔV=5 m/min., or so. Further, the value n may be determined in consideration of the computability of the microcomputer 40 and the precision of presumption of the value of the present time, and the value at n=1, namely, preceding one unit of time may well be used as the value of the present time. Besides, as the new value, the value of the arithmetic mean indicated in this embodiment may well be replaced with a value which is presumed on the basis of a weighted mean obtained by weighting the respective time-serial values.

As described above, when the signal varies greatly, the value thereof is presumed, whereby even if the transmission interface undergoes faults ascribable to noise etc., the cage can be operated safely. Moreover, even in a case where the first microcomputer 30 generating the normal reference speed command signal $V_N$ undergoes a malfunction ascribable to noise and gives rise to a sudden change in the signal $V_N$, the cage can be operated safely.

Figure 3:
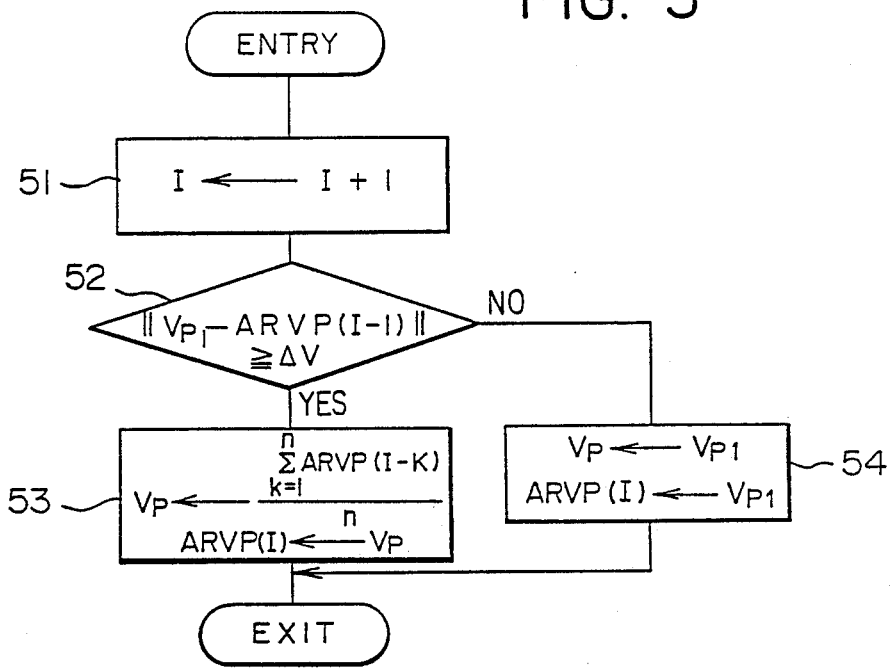
FIG. 3 is a flow chart showing the steps of setting a signal in an embodiment of this invention.
Figure 4:
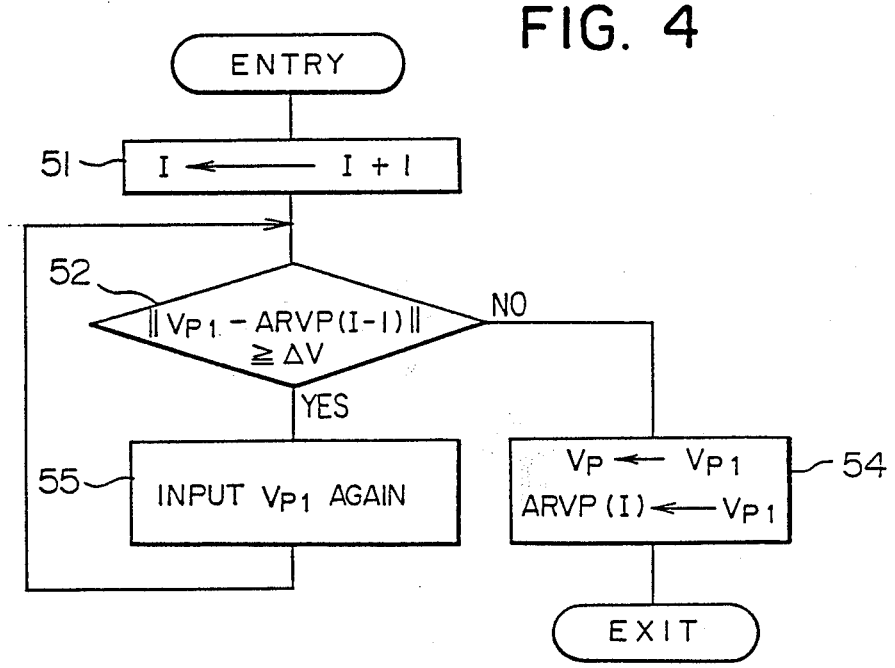
FIG. 4 is a flow chart showing another embodiment of the steps in FIG. 3.

FIG. 4 is a flow chart showing an embodiment different from the embodiment of FIG. 3. Steps 51, 52 and 54 are the same as in FIG. 3. At a step 55, the transmitted reference speed command signal $V_{P1}$ is input again by the transmission interface 22, whereupon the operating flow returns to the step 52. Thus, the same effects as in FIG. 3 can be expected concerning the malfunctions of the transmission interface etc.

Figure 5:
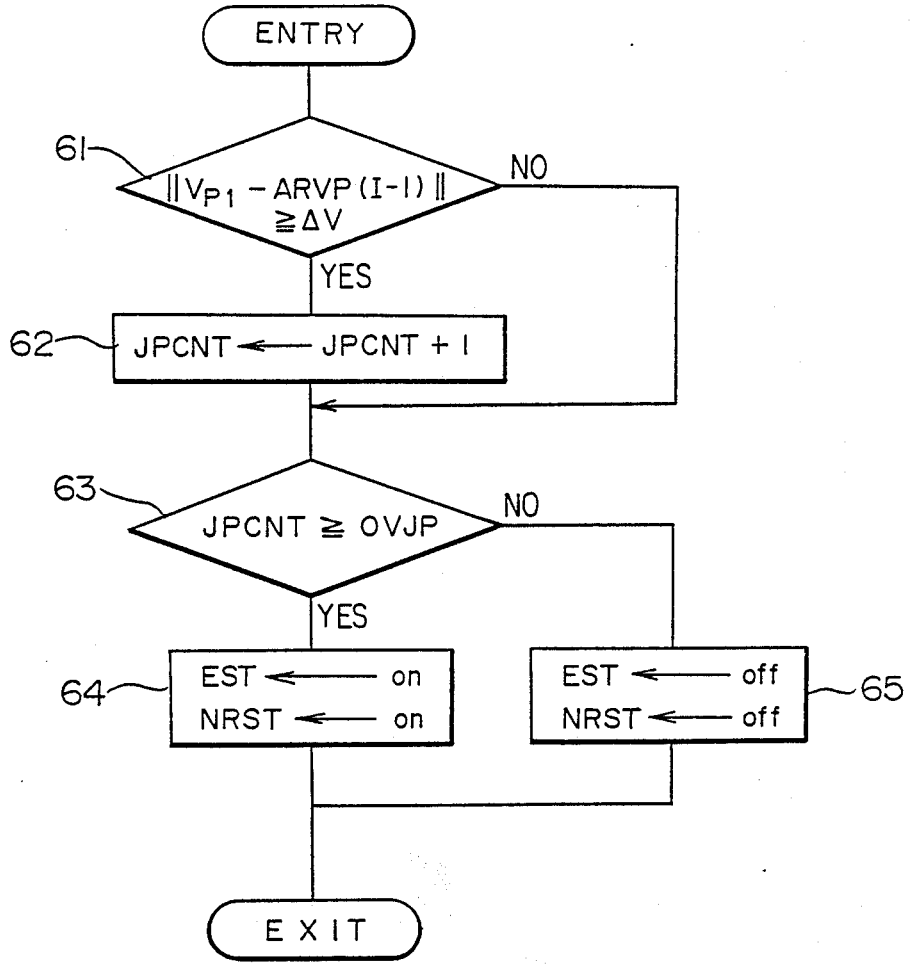
FIG. 5 is a flow chart showing a modification to the embodiment of FIG. 3 or FIG. 4.

FIG. 5 is a flow chart showing a modification to the embodiment of this invention illustrated in FIG. 3 or FIG. 4. The program in this flow chart consists in that the number of times which the signal has jumped or varied greatly is counted, and that if the count value (JPCNT) is not less than a predetermined number of times (OVJP), an emergency stop command EST for the elevator is turned "on," while at the same time, a non-restartable flag is set "on." It will now be explained in detail.

A step 61 in FIG. 5 decides whether or not the transmitted reference speed command signal $V_{P1}$ jumps or varies greatly at the present time. For "NO," the operating flow proceeds to a step 63, and for "YES," the operating flow proceeds to a step 62, at which the stored variable JPCNT indicative of the number of times of jumps is incremented by one.

Besides, at the step 63, whether or not the number of times JPCNT reaches the predetermined number of times OVJP is decided. Here, when JPCNT≧OVJP holds, the operating flow shifts to a step 64, at which the emergency stop command EST for the elevator is turned "on," and simultaneously, the non-restartable flag NRST is turned "on." That is, the elevator is stopped suddenly and is simultaneously brought into the non-restartable state. On the other hand, when the number of times JPCNT is less than the predetermined number of times OVJP at the step 63, the operating flow proceeds to a step 65, at which both the emergency stop command EST and the non-restartable flag NRST of the elevator are turned "off" so as to keep the elevator capable of the ordinary running thereof.

Thus, the elevator can operate normally against the temporary malfunction, fault, etc. of the transmission interface attributed to noise and a power source surge, whereas the elevator is stopped suddenly and is rendered non-restartable in response to the continuous malfunction or fault of the transmission interface 22 or the first microcomputer 30, so the safety of the elevator is secured more.

The above embodiment has referred to the case where the emergency stop command is issued when a sudden change has arisen in the transmitted reference speed command signal $V_{P1}$. However, there is the possibility that a sudden change will also in the cage speed signal $V_T$. Since the motor (5 in FIG. 8) is feedback-controlled on the basis of the deviation between the signals $V_{P1}$ and $V_T$, it holds true that the acceleration of the cage changes rapidly due to the sudden change in the signal $V_T$.

Figure 6:
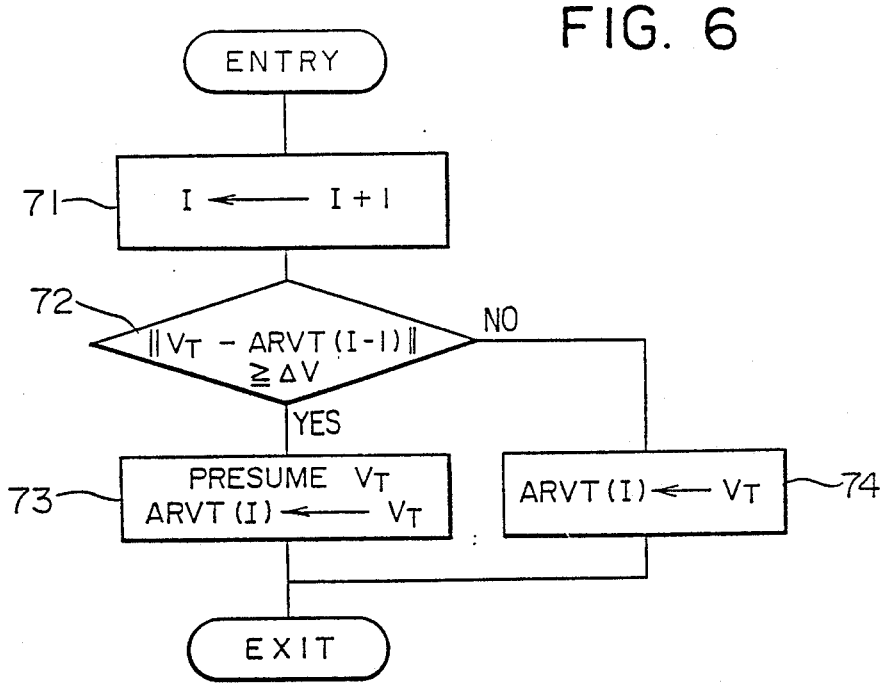
FIGS. 6 and 7 are flow charts each showing an embodiment of an emergency stop command process in this invention.

FIG. 6 is a flow chart showing an example in the case where, when the cage speed signal $V_T$ has suddenly changed as stated above, the emergency stop command can be generated.

Referring to the figure, at a step 71, a pointer I expressive of a time is incremented by one. At the next step 72, the absolute value of the difference between the present value of the cage speed signal $V_T$ and the past value thereof preceding one unit of time and stored in arrayed variables ARVT, namely, ARVT(I−1) is taken, and it is compared with a predetermined value ΔV. Here, if the absolute value is equal to or greater than ΔV, it is decided that the signal $V_T$ transmitted at the present time greatly varies in view of the past time-serial signal ARVT(I−1), and the operating flow proceeds to a step 73, at which a new value not greatly varying is presumed, and it is set as the speed signal $V_T$ again and is simultaneously stored as the arrayed variable ARVT(I). As a method of the presumption, it is mentioned, for example, to evaluate an arithmetic mean as explained in conjunction with FIG. 3 or to evaluate a weighted mean. On the other hand, if the aforementioned absolute value is found to be less than ΔV, it is decided that the present value of the signal $V_T$ is normal, and the operating flow proceeds to a step 74, at which this value is stored as the arrayed variable ARVT(I).

As still another embodiment (not shown), the speed signal $V_T$ may well be input again as in FIG. 4 when it has varied greatly.

Figure 7:
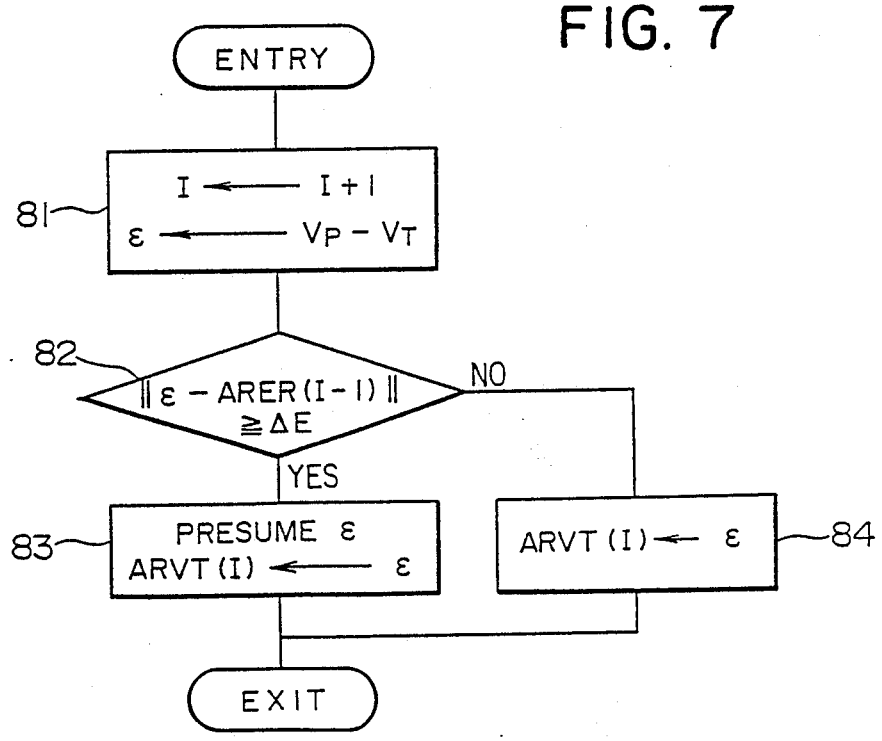

FIG. 7 is a flow chart showing yet another embodiment of this invention endowed with both the functions elucidated in FIG. 3 and FIG. 6.

Referring to FIG. 7, at a step 81, a pointer I expressive of a time is incremented by one, and the error or deviation $\epsilon$ of $V_P - V_T$ is taken out. At the next step 82, the absolute value of the difference between the value of the error $\epsilon$ at the present time and that of the error $\epsilon$ before one unit of time as stored in arrayed variables ARER, namely, (ARER(I−1) is taken, and it is compared with a predetermined value ΔE. Here, if the absolute value is equal to or greater than ΔV, it is decided that the error $\epsilon$ transmitted at the present time varies greatly from the past time-serial signal ARER(I−1), and the operating flow proceeds to a step 83, at which a new value not greatly varying is presumed, and it is set as the present error signal $\epsilon$ again and is simultaneously stored as the arrayed variable ARER(I). On the other hand, if the aforementioned absolute value is found to be less than ΔE, it is decided that the signals $V_P$ and $V_T$ at the present time are normal, and the operating flow proceeds to a step 84, at which the present value of the error $\epsilon$ is stored as the arrayed variable ARER(I).

Accordingly, this embodiment has the effect that the cage can be safely operated in both the cases of a sudden change in the transmitted reference speed command signal $V_P$ and a sudden change in the cage speed signal $V_T$.

As still another embodiment, the transmitted reference speed signal $V_P$ and the cage speed signal $V_T$ may well be input again when they have changed suddenly.

When the embodiment in FIG. 6 or FIG. 7 is additionally furnished with the function of counting the number of times of sudden changes as illustrated in FIG. 5, a still better effect is achieved.

In the embodiment of FIG. 7, the equation $\epsilon = V_P - V_T$ is calculated, but it is a necessary deviation variable in the feedback operation of the speed control. Therefore, when the result in the feedback operation is utilized, the actual calculation of the equation $\epsilon = V_P - V_T$ is not required.

Figure 8:
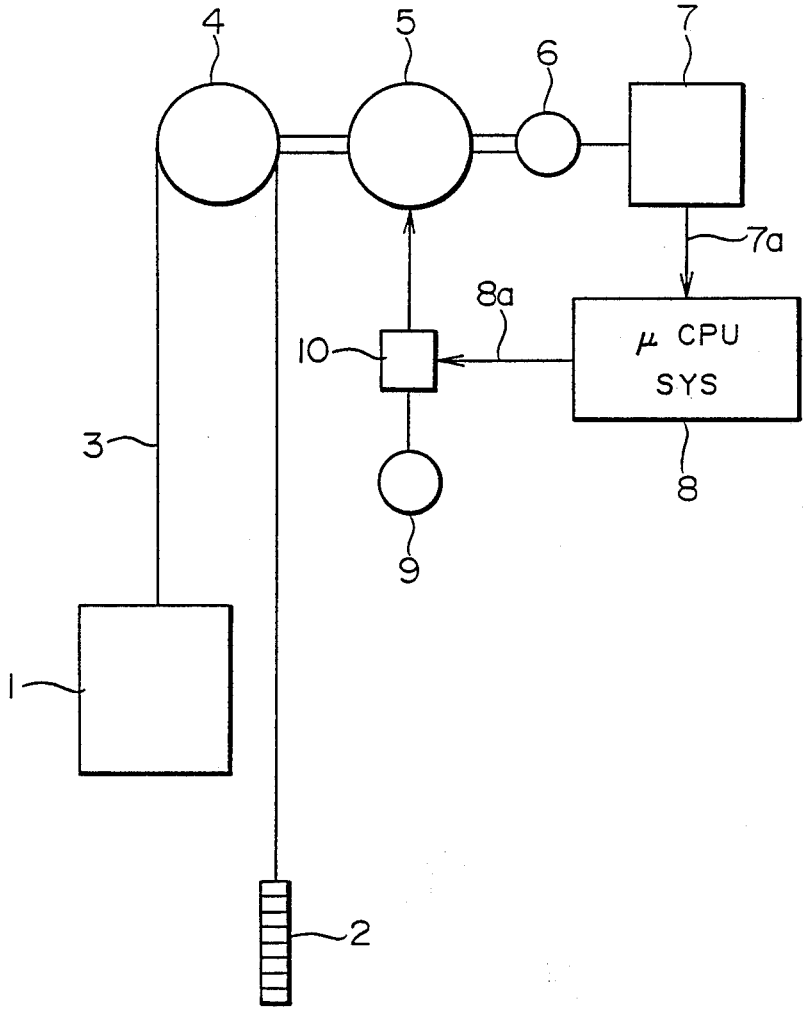
FIG. 8 is an arrangement diagram showing the entirety of an elevator control system.
Figure 9:
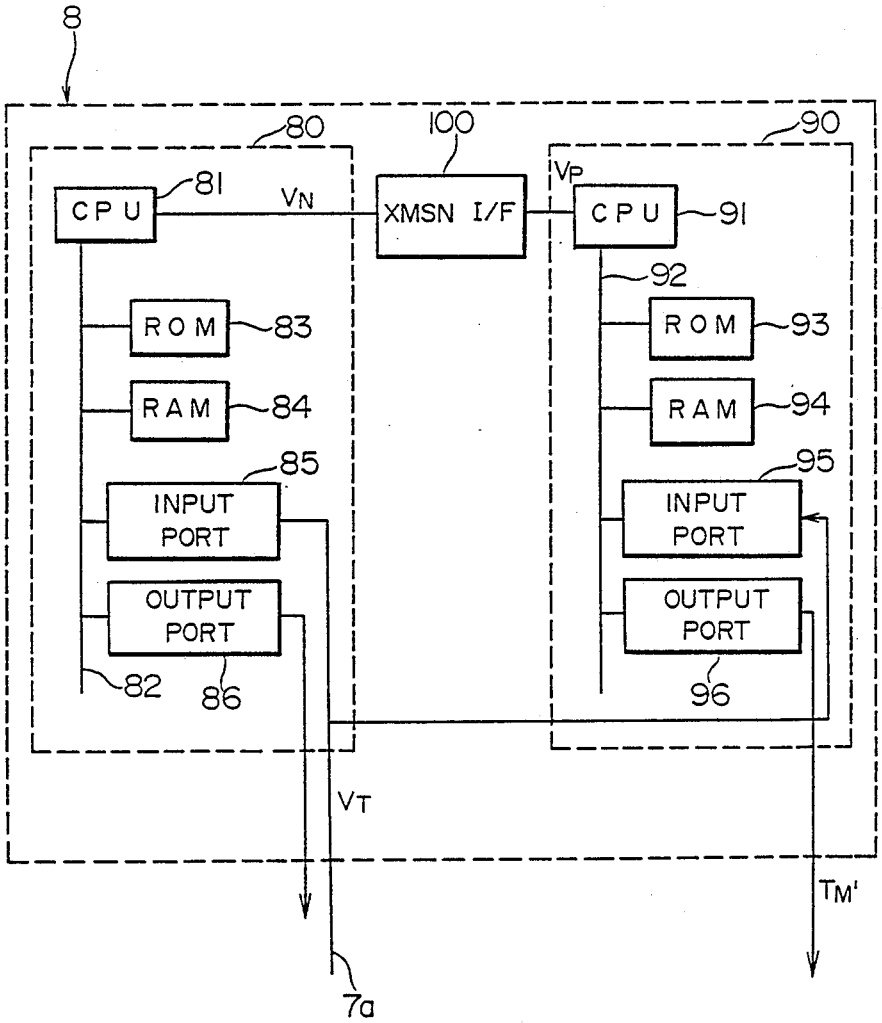
FIG. 9 is a block diagram of an elevator control apparatus in a prior art.
Figure 10:
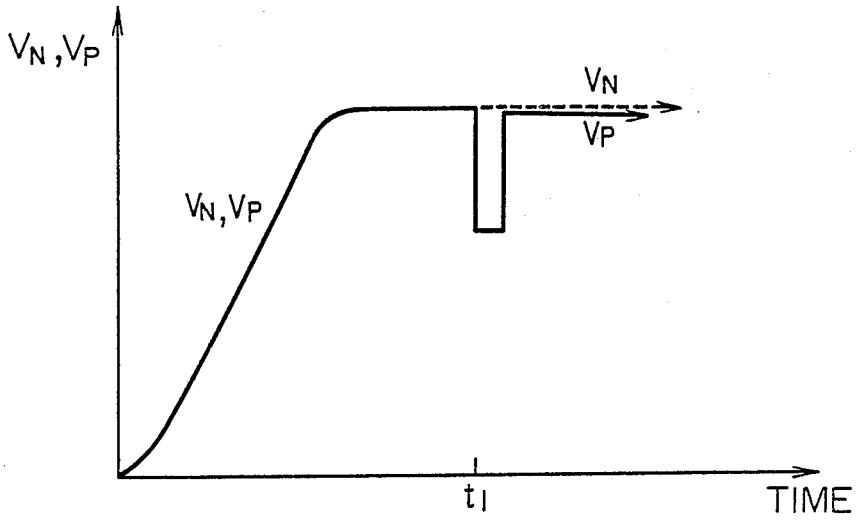
FIG. 10 is a graph of speed characteristics for explaining the operation of the prior art.

Further, the sudden change has been found on the basis of the equation $\epsilon = V_P - V_T$ in the embodiment of FIG. 7. However, even when the sudden change of the torque command $T_M$ toward the power converter 10 as shown in FIG. 8 is found, the invention can be performed similarly.

As described above, according to this invention, the present and past time-serial values of a transmitted reference speed command signal or a cage speed signal required for the speed control calculation of an elevator or a controlled variable based on these signals are compared so as to find whether or not a sudden change exists in the present value, whereupon a new value not changing suddenly is set as a signal value at the present time. Therefore, the invention has the effect that, even when a malfunction has occurred in any of a transmission interface, cage speed signal-generation means, etc., the speed of the cage does not change rapidly, so that the elevator equipment can be prevented from being damaged, and the safety of passengers can be ensured.

What is claimed is:

1. A control apparatus for an elevator comprising means for generating a reference speed command signal; means for detecting a cage speed signal, a transmission interface which transmits the reference speed command signal from the signal generation means; and a speed controller which controls a speed of a cage on the basis of a deviation between a transmitted reference speed command signal obtained through the transmission interface and the cage speed signal from the signal detection means; and signal setting means for setting a new value not varying suddenly, as a value at the present time when a present value of the transmitted reference speed command signal sent by said transmission interface, the cage speed signal, or a controlled variable based on these signals varies suddenly from a past time-serial value of the corresponding signal.

2. A control apparatus for an elevator as defined in claim 1, wherein said signal setting means renders the cage restartable when the number of times of the sudden variations of the signal is less than a predetermined number of times, and it gives the cage an emergency stop command and simultaneously renders the cage non-restartable when the number of times of the sudden variations is equal to or greater than the predetermined number of times.

3. A control apparatus for an elevator as defined in claim 1, wherein said signal setting means sets an arithmetic mean of time-serial values as the new value to be used when the signal varies suddenly.

4. A control apparatus for an elevator as defined in claim 1, wherein said signal setting means sets a weighted mean of time-serial values as the new value to be used when the signal varies suddenly.

5. A control apparatus for an elevator as defined in claim 1, wherein said signal setting means sets a re-input value as the new value to be used when the signal varies suddenly.

6. A control apparatus for an elevator, comprising:

a first microcomputer which generates a reference speed command signal being a command for a running speed of a cage;

a transmission interface through which the reference speed command signal generated by said first microcomputer is transmitted to a second microcomputer as a transmitted reference speed command signal;

cage speed signal-generation means for detecting the running speed of the cage as a cage speed signal;

speed control means for generating a signal for controlling the speed of the cage, on the basis of a deviation between the transmitted reference speed command signal sent by said transmission interface and the cage speed signal from said cage speed signal-generation means; and signal setting means for setting a new value as a present signal value when at least one of the transmitted reference speed command signal, the cage speed signal and the deviation varies suddenly as compared with a time-serial value of the same signal detected in the past.

7. A control apparatus for an elevator as defined in claim 6, wherein said cage speed signal-generation means includes a pulse generator which generates pulses proportional to a movement distance of the cage, on the basis of a rotation of a motor for driving the cage, and a counter circuit which counts the number of the pulses from said pulse generator and delivers the cage speed signal.

8. A control apparatus for an elevator as defined in claim 6, wherein said signal setting means includes storage means for storing the signal value of the transmitted reference speed command signal, the cage speed signal or the deviation of these signals as precedes one unit of time; comparison means for comparing the signal value stored in said storage means and the present signal value and for delivering a difference between both the signal values as an output; and decision means for comparing the output value of said comparison means and a preset reference value and for setting the new value when the output value is greater than the reference value.

9. A control apparatus for an elevator as defined in claim 8, wherein the signal to be stored in said storage means is the transmitted reference speed command signal, and the reference value is set so as to correspond to 5 m/min.

10. A control apparatus for an elevator as defined in claim 9, wherein said signal setting means includes a counter which counts the number of times of the sudden variations of the signal as indicated by said decision means, and means for comparing the count value of said counter and a preset number of times and for issuing an emergency stop command and a non-restartable signal to the cage when the count value has exceeded the set number of times.

* * * * *